United States Patent [19]

Reyes

[11] 4,175,641

[45] Nov. 27, 1979

[54] STEP LADDER LEG SUPPORT

[76] Inventor: George Q. Reyes, 154 Farrell Dr., San Antonio, Tex. 78227

[21] Appl. No.: 871,033

[22] Filed: Jan. 20, 1978

[51] Int. Cl.[2] ..... E06C 1/22

[52] U.S. Cl. ..... 182/172; 182/108

[58] Field of Search ..... 182/172, 107, 108, 109, 182/110, 111, 204

[56] References Cited

U.S. PATENT DOCUMENTS

| | | | |
|---|---|---|---|
| 2,484,389 | 10/1949 | Schatz | 182/201 |
| 3,878,917 | 4/1975 | McBride | 182/172 |

FOREIGN PATENT DOCUMENTS

| | | | |
|---|---|---|---|
| 1351393 | 12/1963 | France | 182/172 |

*Primary Examiner*—Reinaldo P. Machado

*Attorney, Agent, or Firm*—Ranseler O. Wyatt

[57] ABSTRACT

A leg support for step ladders, wherein a pair of pivotal members are mounted adjacent the top of the ladder for lateral support, extending outwardly and downwardly when in supporting position, terminating in pivotally mounted feet. The pivotal members are maintained in fixed position on the ladder by a collar, and set screws in the collar, and a sliding bar extends from one set of legs to the other, to support the pivotal members. Extension members telescopically connected with the pivotal members, provide means for selectively adjusting the length of each supporting member.

2 Claims, 4 Drawing Figures

STEP LADDER LEG SUPPORT

BACKGROUND OF THE INVENTION

In using stepladders, particularly with just one worker present, many accidents occur because of the need to climb high on the ladder, and the resulting top heavy imbalance, or where the ladder is used on the ground, uneven terrain prevents a firm footing for the ladder, with the same resulting danger. An easily portable and readily adaptable means for guarding against such accidents is definitely needed in the industry, and is the object of this invention.

SUMMARY OF THE INVENTION

A stepladder supporting means consisting of a pair of pivotally mounted members detachably secured to the upper portion of a stepladder, having means for distributing the load over both front and rear sets of the stepladder legs, said means having pivotally mounted feet adapted to provide secure contact with the ground, and having means for telescopically adjusting the length of the pivotal members.

DESCRIPTION OF THE PREFERRED EMBODIMENT

Figure 1:
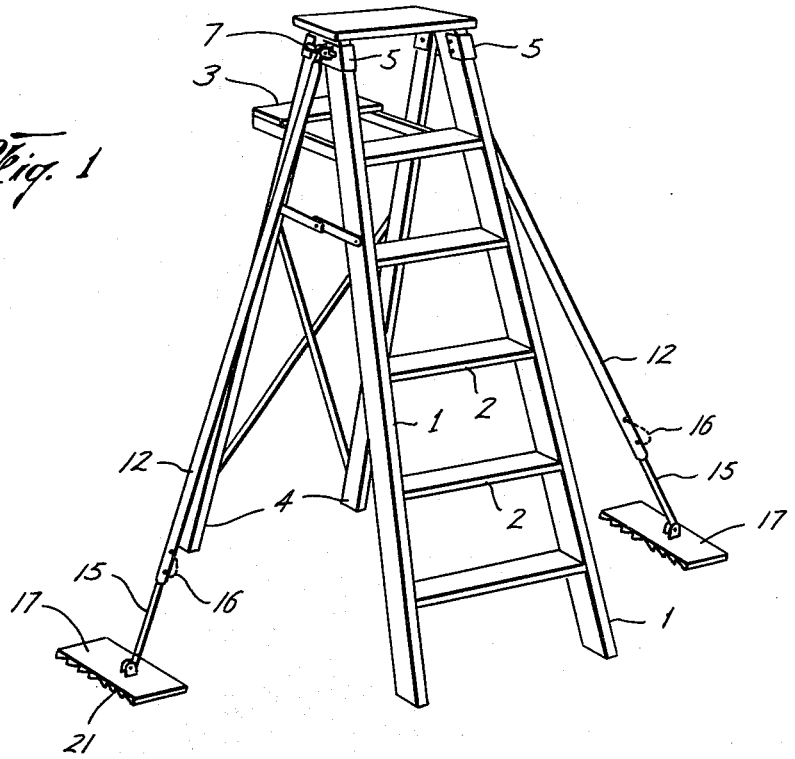
FIG. 1 is an elevational perspective view of a stepladder with the supporting members mounted thereon.
Figure 2:
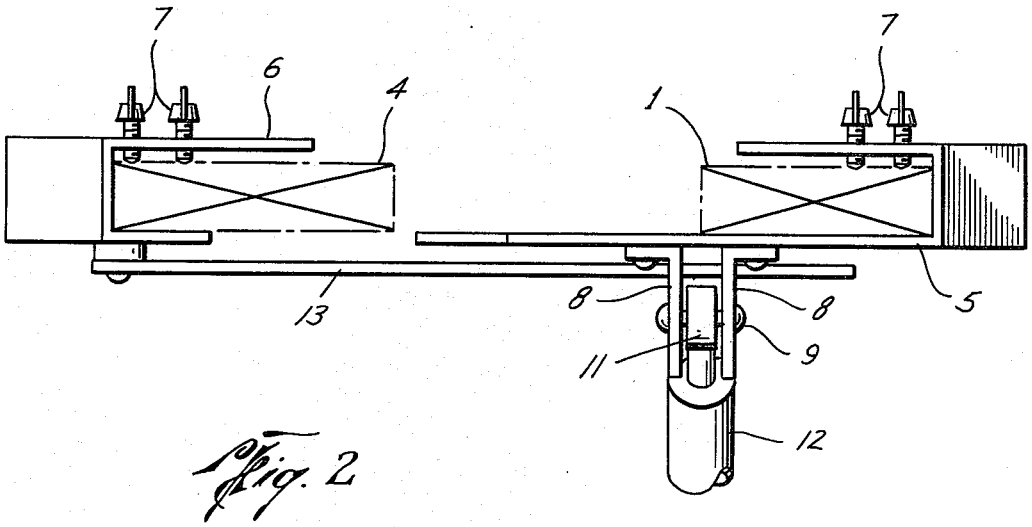
FIG. 2 is a top plan view of the view shown in FIG. 1.
Figure 4:
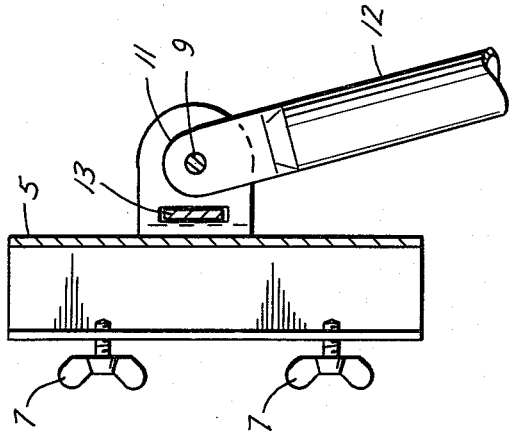
FIG. 4 is a fragmentary elevational view of the pivotal member and collar.
Figure 3:
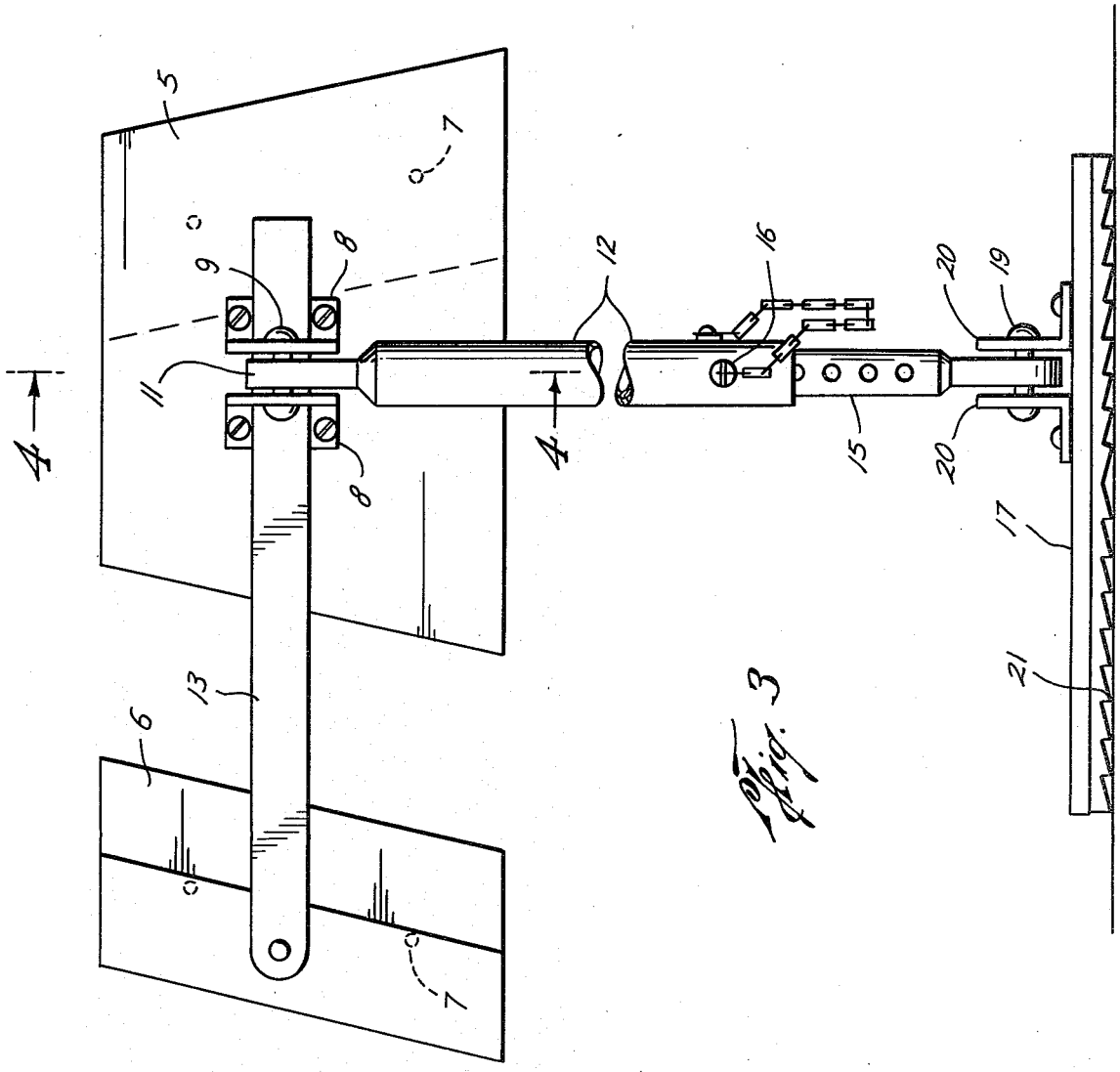
FIG. 3 is an enlarged side elevational view.

In the drawings, the numerals 1, 1 designate the forward set of legs of the conventional stepladder, which has the usual steps 2, 2 and extension lock 3. Mounted on the upper end of the front set of legs 1, 1 and the rear set of legs 4, 4 are the collars 5, 6 which are maintained in place by means of the set screws 7, 7. One side of the collar 5 is extended inwardly and has the facing brackets 8, 8 fixedly mounted thereon. A pin 9 extends transversely through said brackets and through the eye 11 mounted in the upper end of the pivotal member 12. A sliding bar 13 is pivotally mounted on the collar 6 and extends through the slot 14 in the brackets 8, 8, distributing the load between the respective collars.

The pivotal members 12, 12 have the telescoping extensions 15, 15 and passageways are formed in the lower portion of the pivotal members 12, 12 and in the upper portion of the extensions 15, 15 by receiving the locking pins 16, 16 at the selected position. Flat, rectangular feet 17, 17 are pivotally mounted on the extended ends of the extensions 15, 15 by means of the eye 18, through which the pins 16 pass, and the brackets 20, 20 also through which the pin 19 passes. Non-skid, two directional flexible grips 21, 21 are mounted at the bottom of the feet 17, 17.

In use, where the step ladder is being used on a level surface, such as a building floor, or the like, the pivotal members 12 may be inactive, the extensions 15 being pinned out of contact with the floor. If there is need for the support, the pivotal members 12 are swung outwardly, and the extension members 15 pinned so that the feet 17 are firmly in contact with the floor, with the non-skid grips preventing the feet from sliding. If the stepladder is being used on the ground, where the terrain is uneven, the pins permit adjustment of the extension members individually so that the ladder will be equally secured from both sides.

What I claim is:

1. In a stepladder support load equalizing means, pivotal members extending laterally therefrom, means for vertically adjusting the pivotal members individually to maintain the stepladder secure, pivotal feet horizontally mounted on the extended end of said members, collars mounted on the upper portion of the stepladder and the pivotal members extending from said collars and an equalizing bar mounted on the upper portion of said stepladder and extending through said collar.

2. In a stepladder support, load equalizing means, pivotal members extending laterally therefrom, means for vertically adjusting the pivotal members individually to maintain the stepladder secure and pivotal feet horizontally mounted on the extended end of said members, collars adapted to be mounted on the upper end of the stepladder and anchored in place thereon, a sliding bar pivotally mounted on one collar and a bracket on the other collar supporting the pivotal members, said bracket having a transfers slot therethrough which receives said sliding bar.

* * * * *